US008337677B2

(12) United States Patent
Glass et al.

(10) Patent No.: US 8,337,677 B2
(45) **Date of Patent: *Dec. 25, 2012**

(54) SACRIFICIAL ANODE AND BACKFILL

(76) Inventors: Gareth Glass, Lichfield (GB); Nigel Davison, Swadlincote (GB); Adrian Roberts, Chilwell (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/213,151

(22) Filed: Aug. 19, 2011

(65) Prior Publication Data

US 2011/0303530 A1 Dec. 15, 2011

Related U.S. Application Data

(62) Division of application No. 12/067,632, filed as application No. PCT/GB2006/050310 on Oct. 2, 2006, now Pat. No. 8,002,964.

(30) Foreign Application Priority Data

Oct. 4, 2005 (GB) ..... 0520112.4
Jan. 13, 2006 (GB) ..... 0600661.3
Mar. 27, 2006 (GB) ..... 0605988.5

(51) Int. Cl.
*C23F 13/12* (2006.01)

(52) U.S. Cl. ..... 204/196.36; 204/196.37; 264/36.18; 264/36.2

(58) Field of Classification Search ..... 204/196.36, 204/196.37; 264/36.18, 36.2
See application file for complete search history.

(56) References Cited

U.S. PATENT DOCUMENTS 4,623,435 A * 11/1986 Nebgen et al. ..... 205/733
4,746,249 A * 5/1988 Haigh et al. ..... 405/264
5,040,599 A * 8/1991 Pfalser et al. ..... 166/248
5,292,411 A 3/1994 Bartholomew et al.
5,464,473 A * 11/1995 Shiao ..... 106/811
5,476,576 A 12/1995 Solomon et al.
6,193,857 B1 2/2001 Davison et al.
6,254,752 B1 7/2001 Miller
6,303,017 B1 10/2001 Page et al.
6,419,816 B1 7/2002 Lyublinski (Continued)

FOREIGN PATENT DOCUMENTS

EP 0 499 437 A1 8/1992
GB 2 368 840 A 5/2002
GB 2 389 591 A 12/2003
GB 2 427 618 A 1/2007
JP 4 116184 4/1992

(Continued)

OTHER PUBLICATIONS

David W. Whitmore, Installation of Embedded Galvanic Anodes, American Concrete Institute, 2005.

*Primary Examiner* — Bruce Bell
(74) *Attorney, Agent, or Firm* — Davis & Bujold, PLLC

(57) ABSTRACT

The installation and use of embedded sacrificial anodes to protect reinforced concrete may be improved. In one example a cavity [2] is formed in the concrete [3] and a puttylike backfill [4] is placed in the cavity and a compact discrete anode comprising a sacrificial metal element [1] is inserted into the backfill and a space is provided into which the backfill may move when subjected to a pressure arising from the formation of voluminous sacrificial meal corrosion products and a high current is passed from the anode to the steel in the concrete to arrest steel corrosion and activate the anode in the backfill. The space may be provided by venting the backfill to space outside the cavity through an opening [5] or by including a void space within the backfill [6] or a void space within the cavity [7].

14 Claims, 2 Drawing Sheets

U.S. PATENT DOCUMENTS

| | | | | |
|---|---|---|---|---|
| 6,572,760 | B2 | 6/2003 | Whitmore | |
| 6,838,525 | B2 * | 1/2005 | Pitchumani et al. | 525/329.7 |
| 7,731,875 | B2 * | 6/2010 | Glass et al. | 264/36.18 |
| 7,749,362 | B2 * | 7/2010 | Glass et al. | 204/196.19 |
| 7,909,982 | B2 * | 3/2011 | Glass et al. | 205/734 |
| 7,967,971 | B2 * | 6/2011 | Davison et al. | 205/734 |
| 8,002,964 | B2 * | 8/2011 | Glass et al. | 205/734 |
| 2002/0023848 | A1 | 2/2002 | Whitmore | |
| 2004/0011669 | A1 * | 1/2004 | Glass et al. | 205/766 |
| 2004/0186221 | A1 | 9/2004 | Pitchumani et al. | |
| 2004/0238347 | A1 | 12/2004 | Bennett | |
| 2008/0105564 | A1 | 5/2008 | Glass et al. | |
| 2009/0229993 | A1 | 9/2009 | Glass et al. | |
| 2009/0236764 | A1 | 9/2009 | Glass et al. | |
| 2010/0147703 | A1 * | 6/2010 | Glass et al. | 205/732 |
| 2010/0314262 | A1 * | 12/2010 | Glass et al. | 205/734 |
| 2011/0168571 | A1 * | 7/2011 | Glass et al. | 205/734 |
| 2012/0111736 | A1 * | 5/2012 | Glass et al. | 205/734 |

FOREIGN PATENT DOCUMENTS

| | | | |
|---|---|---|---|
| WO | 94/29496 | A1 | 12/1994 |
| WO | 96/00805 | A1 | 1/1996 |
| WO | 03/010358 | A2 | 2/2003 |
| WO | 03/027356 | A1 | 4/2003 |
| WO | 2005/035831 | A1 | 4/2005 |
| WO | 2006/097770 | A2 | 9/2006 |

* cited by examiner

SACRIFICIAL ANODE AND BACKFILL

TECHNICAL FIELD

The present invention relates to the protection of steel in concrete using sacrificial metal anodes, the backfills in contact with sacrificial metal anodes embedded in cavities in concrete and reinforced concrete structures wherein the steel reinforcement is protected using sacrificial metal anodes.

BACKGROUND ART

Discrete sacrificial anodes have been embedded in cavities in concrete to protect the reinforcing steel. In the process the sacrificial metal element dissolves and a protection current flows from the anode to the steel. A backfill is a material surrounding the sacrificial metal element of the anode that maintains an electrolytic contact between the electrolyte in the surrounding environment and the surface of a sacrificial metal element. In anodes for reinforced concrete, the backfill will also contain an activating agent that maintains anode activity. An anode is an electrode that supports a net oxidation reaction on its surface such as the dissolution of a sacrificial metal element in the case of a sacrificial anode. To protect the steel, electrons must flow from the anode to the steel. This electron movement may be promoted by the presence of a power supply between the anode and the steel. The electron movement will primarily occur in electron conducting conductors. Furthermore ions must move through the electrolyte between the anode and the steel. Positive ions will move from the anode to the steel when the steel is protected. A flow of both electronic and ionic current occurs in the process of protecting the steel.

One commercially available sacrificial anode assembly based on WO 94/29496 comprises a zinc metal element activated by hydroxyl ions in a porous material that surrounds the zinc. The zinc corrodes to form soluble products that precipitate out in the pores of the surrounding material. The anode and backfill are pre-formed as a rigid unit. The unit is subsequently installed in a cavity that is formed in a concrete structure. An embedding mortar, which will typically be a cementitious repair mortar, is used to fill the space between the unit and the concrete surface of the cavity. This mortar fixes the unit in place and provides a path for electrolytic contact between the electrolyte in the backfill and the electrolyte in the surrounding concrete.

SUMMARY OF INVENTION

Technical Problem

The problem to be solved by this invention is to protect reinforced concrete using embedded sacrificial metal anodes in an effective and simple manner.

Sacrificial anodes may be applied to concrete surfaces or embedded in cavities formed in the concrete. Anodes applied to concrete surfaces often loose adhesion to the concrete surface. Embedding compact discrete sacrificial anodes in cavities in the concrete provides a solution to the achievement of a durable attachment between the sacrificial anode and the concrete. However sacrificial anodes have a limited life because they are consumed in the delivery of the protection current and it is difficult to replace embedded sacrificial anodes at the end of their life.

A sacrificial metal element dissolves to form products that often have a greater volume than the metal from which they were derived. As a result, a pressure builds up that can lead to damage in a rigid material like concrete. The backfill of a sacrificial anode should be capable of accommodating the expansive products of the anodic dissolution reaction. Accommodating the voluminous products of sacrificial metal dissolution is addressed directly in WO 03/027356 and WO 2005/035831. However, when sacrificial metal dissolution is accelerated using a DC power supply, high volume products will be produced at a rate much greater than that encountered in the more conventional use of sacrificial anodes. As a result an improved method of accommodating this relatively rapid expansion is needed.

Activated sacrificial anode products for embedding in cavities in reinforced concrete normally include a preformed porous solid containing an activating agent around the sacrificial metal element. The anodes are then embedded in another embedding material in the cavity that is formed in the concrete. As a result at least one additional interface is formed across which the protection current must flow. These interfaces can present weaknesses in the anode system and result from an increase in the number of processes to form an installed anode system.

The embedding material for discrete sacrificial anodes is normally a cementitious mortar that is mixed with water under construction site conditions and sets as the result of a reaction between the water and the cement particles. Control of the mixing proportions is more difficult under site conditions than under factory conditions and it would be preferable to use and embedding material that does not require the mixing of separate components on site.

When a current is impressed off a sacrificial metal element using a DC power supply, all the metal conductors and connections to the sacrificial metal element are at risk of corroding as these components are no longer protected by the natural action of the sacrificial metal. The steel conductor that is normally connected to a sacrificial metal anode would corrode if the sacrificial metal element was driven to a sufficiently positive potential by being connected to the positive terminal of a DC power supply.

Technical Solution

In one example, a method of protecting steel in concrete comprises forming a cavity in the concrete and placing a puttylike ionically conductive backfill in the cavity and inserting a compact discrete anode comprising a sacrificial metal element less noble than steel into the backfill such that the sacrificial metal element makes contact with the backfill and providing a space into which the backfill may move when subjected to pressure and passing a current from the anode to the steel in the concrete.

The backfill is a pliable, viscous material that preferably retains its pliable, viscous properties while a high current density is impressed off the sacrificial metal element. The backfill preferably retains its pliable, viscous properties while contact between the backfill and the atmosphere is avoided. The backfill may harden slowly to preferably form a weak porous material that can accommodate the longer term, lower expansion rates resulting from the reduced rate of forming products at the anode after an initial high impressed current treatment. The conductivity of the backfill primarily arises from one or more dissociated salts within an electrolyte in the backfill. Possible backfills comprise a colloidal suspension of fine passive solid particles in water. One example of a backfill consists at least in part of lime putty.

A high current is preferably induced off the sacrificial metal element to flow to the steel in the concrete for a brief period by, for example, connecting the anode to the positive terminal and the steel to the negative terminal of a source of DC power. This draws ions such as chlorides and sulphates from the concrete into the backfill. These ions may act to maintain sacrificial metal element activity which enables the sacrificial metal element to be connected directly to the steel for use in a more conventional galvanic anode role.

The sacrificial metal element is a metal less noble than steel such as zinc, aluminium or magnesium or an alloy thereof. It is preferable to connect it to a conductor that remains passive when the sacrificial metal element is connected to the positive terminal of a source of DC power to form an impressed current anode connection detail. Examples of passive conductors include inert conductors like titanium and conductors that include an insulating sheath to separate the conductor from the environment. The conductor and conductor to anode connection should preferably suffer no more corrosion than a conductor or connection that remains electrochemically passive while in contact with the electrolyte in the concrete and while connected to the anode in the impressed current electrochemical treatment of reinforced concrete.

The space may be provided by venting the backfill to space outside the cavity or by including compressible void space within the cavity or within the backfill. The delivery of a high current off the anode may only be required for a relatively brief initial period to arrest corrosion during which a space into which the backfill may move is preferably provided outside the cavity. A space may also be provided by a weak foamed polymer that traps air within the cavity formed in the concrete. The foamed polymer is preferably located in close proximity to the sacrificial metal element.

Advantageous Effects

Embedding compact discrete anodes in cavities in concrete provides a method of reliably securing the anode to the concrete structure. Impressing a high current density off the anode using a source of DC power provides a method of rapidly arresting the corrosion process on the steel. It also draws aggressive ions from the concrete to the anode to form an activated sacrificial anode and reduces the need to include an activating agent in the backfill.

The provision of a puttylike backfill and a space allows the fast generation of high volume product arising from the delivery of a high current density off a sacrificial anode embedded in a cavity in concrete to be accommodated. The putty also retains electrolyte in the longer term to ensure anode function. The use of a putty as a backfill means the interfaces formed may be limited to the interface between the sacrificial metal element and the backfill and the interface between the backfill and the concrete. The number of processes to achieve an installed anode assembly may be reduced as no backfill is applied to the sacrificial metal element in the factory and the backfill installed on site acts as both a backfill and an embedding material.

The use of a putty as a backfill that retains its pliable viscous properties when it is not exposed to the atmosphere means that the anode embedding material can be mixed in a factory environment. It can also be packaged in cartridge-nozzle dispensers to ease the installation process on a construction site. No mixing of embedding material components is required on a construction site. The backfill may be readily injected from a cartridge-nozzle dispenser into a narrow cavity such as a drilled hole in the concrete structure in a similar way to that in which sealants like silicone sealant are dispensed.

The use of a backfill like lime putty that hardens slowly to form a weak porous material means that the anode can easily be removed at the end of its useful life and a new anode can be installed in the same hole. No hard cementitious embedding material needs to be removed.

The overall effect is to make it easier to deliver powerful electrochemical treatments to arrest steel corrosion in concrete using sacrificial metal anodes.

DESCRIPTION OF DRAWINGS

The invention is described below with reference by way of example to the figures in which.

MODE FOR INVENTION

Figure 1:
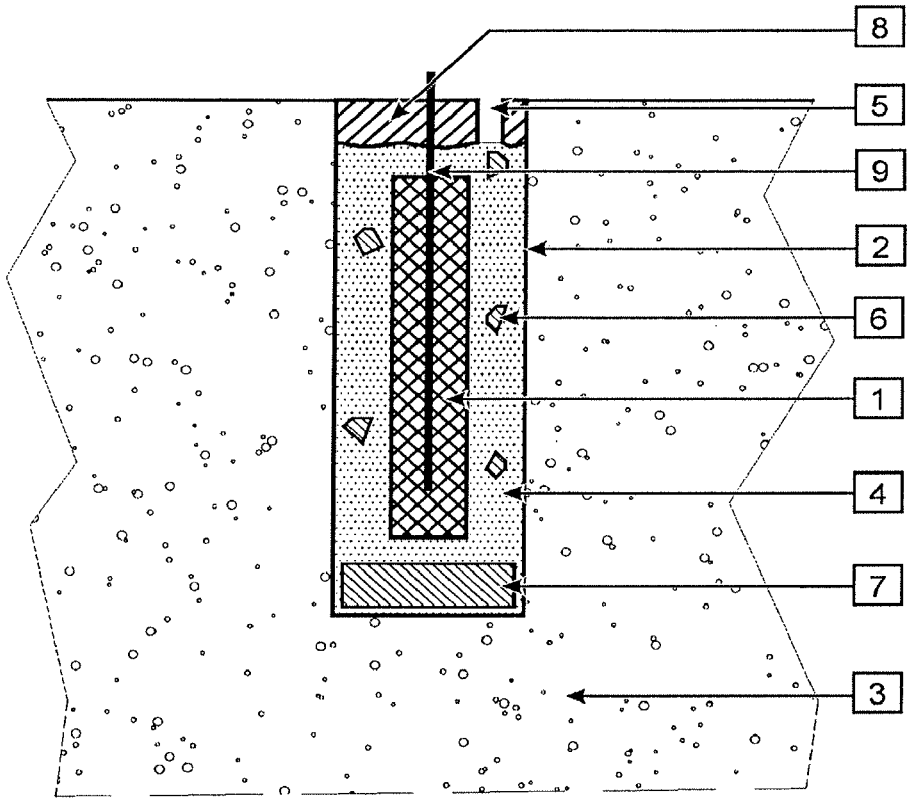
FIG. 1 shows a discrete sacrificial metal anode embedded in a puttylike backfill in a cavity in concrete together with various spaces to accommodate movement of the backfill.

Brief high current electrochemical treatments have been developed to arrest steel corrosion in concrete. A brief high current treatment may involve the delivery of a charge to the steel of the order of 50 to 500 $kC/m^2$ (charge per unit area of steel) in a short period. It is possible to deliver this charge in as little as 48 hours using a power supply but it will typically take 7 days to deliver such a treatment. A sacrificial metal anode embedded in a cavity in the concrete may be used in an impressed current role to assist in the delivery of a high current for a brief period to arrest corrosion. The current density off the sacrificial metal anode will preferably be greater than 200 $mA/m^2$ and more preferably greater than 1000 $mA/m^2$ to deliver this charge in as brief a period as possible. A high current density will typically be more than the maximum recommended current driven off anodes of a similar type when used in impressed current cathodic protection. It is preferable that the brief high current treatment lasts for less than 3 months and more preferably less than one month to minimise the time on site of any temporary equipment that may be used to induce the high current. This high current treatment will preferably be followed by the use of the same anode in a more conventional galvanic role wherein the anode is connected directly to the steel to prevent corrosion initiation by delivering a small current to the steel. This technology is disclosed in WO06097770.

During the brief initial high current treatment, a high volume of product arising from sacrificial metal dissolution may be produced.

Accordingly, this invention provides in one aspect, a method of protecting steel in concrete that comprises forming a cavity in the concrete and placing a backfill in the cavity and inserting an anode comprising a sacrificial metal element less noble than steel into the backfill and passing a current from the sacrificial metal element to the steel in the concrete wherein the backfill is an ionically conductive backfill and the backfill is a pliable viscous material and the dissolution of the sacrificial metal element to produce a high volume product exerts pressure into the pliable viscous backfill and a space is present to accommodate backfill movement when the backfill is placed under pressure.

A brief high current will preferably be induced off the sacrificial metal element to arrest corrosion on the steel reinforcement. For example, this may be achieved by using a temporary source of DC power. It is preferable that the pliable viscous properties of the backfill are at least retained while this high current is delivered from the sacrificial metal element. This will typically be 7 days, but may be as short as 2 days. It is preferable that the pliable viscous properties are retained while the backfill is separated from the atmosphere. This may be used to give the backfill a shelf life prior to use. It is preferable to have a shelf life of at least 1 month and more preferable to have a shelf life of at least 6 months. It is preferable that the backfill is formed in a factory environment and that the backfill is stored in a cartridge. It is preferable that the backfill can be injected from the cartridge into cavities formed in the concrete.

It is preferable that after exposure to the atmosphere, the backfill does not harden fast. More specifically, it is preferable that the compressive strength of the backfill does not exceed 5 $N/mm^2$ within 7 days of exposure to the atmosphere and more preferably does not exceed 2 $N/mm^2$ within 7 days of exposure to the atmosphere. It is preferable that the conductivity of the backfill primarily arises from one or more dissociated salts in an electrolyte contained within the backfill.

The anode is preferably sufficiently compact and discrete that it can fit in a hole 50 mm in diameter and 200 mm in length drilled in the concrete. It comprises a sacrificial metal element that is preferably connected to a passive conductor to form an impressed current anode connection. This connection detail means that the conductor and connection remain passive at the positive anode potentials achieved when the anode is connected to a positive source of DC power during an impressed current treatment. More specifically the conductor and connection remain passive at potentials at least as positive as +500 mV above the copper/saturated copper sulphate reference electrode and preferably at least as positive as +2000 mV above the copper/saturated copper sulphate reference electrode.

While a high current density is induced off the anode surface, it is preferable to provide space for backfill movement to outside the cavity and to connect the backfill to this space through an opening. A space to accommodate backfill movement may also be provided within the cavity in the concrete. Space may be provided by including a weak compressible material within the cavity or within the backfill or attached to the sacrificial metal element.

In another aspect this invention provides a backfill for use in cavities in concrete with a sacrificial metal element less noble than steel to electrolytically connect the sacrificial metal element to an electrolyte in the concrete wherein the backfill substantially comprises a suspension of fine solid particles in water and the fine solid particles are less than 30 micron in diameter and the conductivity of the backfill primarily arises from one or more dissociated salts in the water contained within the backfill and the backfill is a pliable viscous material that retains its pliable viscous properties for a period during which the sacrificial metal element delivers a high current to the steel to arrest steel corrosion and the backfill hardens slowly to form a weak porous material.

The backfill may be supplied as part of an assembly that includes an anode comprising a sacrificial metal element. It is preferable that the sacrificial metal element is connected to a conductor that remains passive at the positive potentials attained when the anode is used as an impressed current anode to form an impressed current anode connection detail. A passive conductor is a conductor that suffers no more anodic dissolution than a conductor that remains electrochemically passive. The anode may then be connected to the positive terminal of a source of DC power for a brief period to drive a high current off the sacrificial metal element to the steel to rapidly arrest steel corrosion.

It is preferable to avoid high water contents in the backfill to limit shrinkage if it dries. More specifically, it is preferable that the water content of the backfill is less than 60% of the weight of the backfill.

It is preferable that the fine solid particles are less than 5 microns in diameter as this eases its installation in narrow cavities and allows the backfill to flow smoothly past a sacrificial metal element that is inserted into the backfill in a cavity.

The fine solid particles are preferably passive in water in that they do not substantially react with water. This prevents the loss of the pliable viscous properties of the backfill. More specifically it is preferable that the backfill remains pliable and viscous for at least 48 hours and more preferably for at least 7 days after exposure to the atmosphere so that it may move when the sacrificial metal element dissolves at a high rate during a brief initial impressed current treatment to form high volume corrosion products. Furthermore it is preferable that the backfill retains its pliable viscous properties for a minimum of 1 month while it is separated from the atmosphere or while it remains waterlogged. In this way the backfill may be mixed and packaged in a factory prior to delivery to site. The backfill is preferably packaged in a cartridge from which it may be directly injected into cavities formed in the concrete structure.

The backfill hardens slowly in contact with the atmosphere to form a weak porous material that retains electrolyte and provides space for the formation of voluminous corrosion product arising from the dissolution of a sacrificial metal element within the backfill at a rate typical of that encountered in the galvanic protection of reinforcing steel. It is preferable that the backfill remains weak to allow easy removal and re-placement of the anode at the end of its functional life. More specifically it is preferable that the compressive strength of the backfill does not exceed 5 $N/mm^2$ within 7 days of exposure to the atmosphere and more preferably will never exceed 5 $N/mm^2$.

It is preferable that a compressible space is provided to accommodate voluminous corrosion product arising from sacrificial metal dissolution. A compressible element such as a foamed polymer may be included within the backfill or within a cavity formed in the concrete or attached directly to the sacrificial metal element. It is preferable that the compressible element is located adjacent to the sacrificial metal element to absorb the corrosion products. It is preferable that the compressible element is attached as strips of compressible material to the sacrificial metal element of the anode to guide the anode towards the centre of a cavity that is formed in concrete.

In another aspect this invention provides an assembly comprising an ionically conductive backfill and an anode for use in cavities in concrete wherein the backfill is a pliable viscous material and the anode comprises a compact discrete sacrificial metal element less noble than steel and a passive conductor wherein the sacrificial metal element is connected to the passive conductor to form an impressed current anode connection characterised in that it suffers no more corrosion than an electrochemically passive conductor at potentials above the copper/saturated copper sulphate reference electrode.

An impressed current anode connection detail on a sacrificial metal element allows the anode to be driven at a high current density without corroding the connection. It is preferable that the passive conductor suffers no more corrosion than an electrochemically passive conductor at potentials above +500 mV on the copper/saturated copper sulphate reference electrode scale and more preferably suffers no more corrosion than an electrochemically passive conductor at potentials above +2000 mV on the copper/saturated copper sulphate reference electrode scale. It is preferable that the backfill retains its pliable viscous properties while a high current is impressed off the sacrificial metal element to the steel using a power supply. This impressed current treatment will last for at least 2 days and will more typically last for at least 7 days.

In another aspect this invention provides an ionically conductive backfill for use in cavities in concrete with a discrete anode less noble than steel that substantially comprises lime putty wherein the backfill is a pliable viscous backfill and the lime putty is a colloidal suspension of fine calcium hydroxide crystals in water.

In a another aspect this invention provides the production of an assembly to be used in the protection of steel in concrete that comprises a sacrificial metal element less noble than steel and a pliable viscous backfill that retains its pliable viscous properties for at least 7 days after exposure to the atmosphere and a porous layer wherein the porous layer is formed into a hollow container and the container is at least in part filled with the pliable viscous backfill and the anode is inserted into the backfill.

The assembly is a unit that is separate from the reinforced concrete. Such an assembly may be installed in the large cavities formed when patch repairing concrete structures and will be preferred because it limits the quantity of pliable viscous backfill that would otherwise be used in large cavities that are formed for reasons other than the need to install compact discrete sacrificial anodes in the concrete.

It is preferable that a compressible space is provided within the container and it is preferable that this space is located adjacent to the sacrificial metal element. It is preferable to seal the container to facilitate transport and storage of the assembly and if the assembly is to be used in an impressed current mode, it is preferable to provide a portion of the container that is easily broken to create an opening to a space outside the container.

FIG. 1, shows one example of an anode comprising a sacrificial metal element [1] less noble than steel that is preferably formed around a wire [9] to provide a connection point, located in a cavity [2] in concrete [3] in a pliable viscous backfill [4]. The principal anodic reaction is the dissolution of the sacrificial metal. The sacrificial metal element is preferably selected from aluminium, zinc or magnesium or an alloy of aluminium, zinc or magnesium.

The anode is preferably a compact discrete anode that may be embedded in a small cavity in the concrete. Examples of such cavities include holes up to 50 mm in diameter and 200 mm in length that may be formed by coring or drilling as well as longer chases up to 30 mm in width and 50 mm in depth that may be cut into the concrete surface. When the cavities are holes formed by drilling, it is preferable to keep the diameter below 30 mm. A number of anodes will typically be distributed over the concrete structure to protect the embedded steel. The installation of anodes in cavities formed in the concrete improves the strength of the attachment or bond between the anode and the concrete and reduces the risk of the anode coming away from the concrete.

The wire [9] is preferably a conductor that remains passive as the anode is driven to positive potentials to deliver a high current density off its surface.

The sacrificial metal element is substantially surrounded by a pliable viscous backfill [4] and preferably makes direct contact with the pliable viscous backfill. The backfill is not rigid and it is also not a runny fluid. The properties of the backfill mean that it can move into adjacent available space when subjected to pressure. The backfill preferably retains is pliable viscous properties while a high rate of production of voluminous products at the sacrificial metal element persists. The rate of production of products is related to the current delivered off the sacrificial metal element. High impressed current densities may be achieved using a DC power supply and are likely to persist for at least 2 to 3 days although they will more typically be delivered for one week. High initial current densities may extend to 3 months. Thus the backfill should retain its pliable viscous properties for at least 48 hours and will preferably retain these properties for up to 3 months.

The backfill is ionically conductive to support the metal dissolution reaction on the sacrificial metal element. The conductivity of the backfill substantially arises from one or more dissociated salts within an electrolyte contained in the backfill. The resulting ions in the electrolyte preferably maintain sacrificial anode activity. Examples of such ions include hydroxyl ions, sulphate ions and halide ions. Sulphate and halide ions may be drawn from the surrounding concrete into the backfill by a brief high impressed current treatment.

The backfill preferably hardens slowly in time, and after hardening it will preferably form a weak porous material capable of continuing to accommodate the voluminous products of the anodic reaction that are generated at a slower rate. It is preferable that the compressive strength of the backfill does not exceed 10 $N/mm^2$ and more preferably does not exceed 2 $N/mm^2$.

Examples of the backfill include gels, clays, putty, and retarded cement or fine mortar paste. Cement products harden by reaction with water (hydration). They can therefore harden under water. In this respect they differ from other suggested backfill materials which may only harden when exposed to the atmosphere and, in some cases, the pliable viscous properties may partially be restored when the backfill is rehydrated.

Gels typically contain more than 60% water. As noted in U.S. Pat. No. 6,254,752, a very high water content is an advantage in temporary electrochemical treatments designed to deliver high currents for a brief period after which the anode system is removed. However dehydration of the gel results in shrinkage that can isolate the anode from the surrounding concrete if the anode is located in a cavity. This is a disadvantage if the anode is intended for longer term use. This will be the case when the sacrificial metal remaining after an initial impressed current treatment is connected to the steel to provide sacrificial or galvanic protection.

Improved dimensional stability may be achieved by reducing the water content. This may be achieved using a dispersion of fine solid particles in water. Clay particles are less than 5 microns in diameter and some clays contain less than 50% water when fully saturated. Silt particles will have diameters of up to 50 microns and sand particles will be larger. The inclusion of larger particles (silt and sand) improves dimensional stability and results in a courser backfill, but fine particles are preferred when the backfill is used with a compact discrete anode in a small cavity formed in the concrete.

Concretes and mortars include substantial quantities of sand and larger aggregate particles as well as relatively little water. When they are based on the use of hydraulic cements like Portland cement, the reaction between the cement and water will typically produce a rigid material in less than 12 hours. This reaction may be retarded by adding a retarding agent that retards the setting reaction of the cement to retain the pliable viscous properties of the concrete or mortar or cement paste mix for a longer period. Cement based mixes harden to form relatively incompressible materials with high compressive strengths which is a disadvantage, but the strength may be reduced and the porosity increased by increasing the water content of the mix.

A preferred backfill contains lime putty produced by slaking quicklime (CaO) to form a colloidal dispersion of fine calcium hydroxide crystals in water. Matured lime putty has a relatively consistent volume and reacts with carbon dioxide in the atmosphere to form a weak porous material consisting mainly of calcium carbonate that has a compressive strength of less than 0.5 $N/mm^2$. Lime putty may be blended with other materials to improve the properties of the backfill. Lime putty like clay does not set while it is waterlogged and the puttylike characteristics can be partially restored after a short period of dehydration if it is mixed with water.

A space is provided into which the backfill will move when subjected to pressure. The space may be provided outside the cavity through an opening. FIG. 1 shows an example of such an opening [5] connecting the cavity to the external environment. A wide opening from the external environment to the cavity may be partially filled with a sealing material [8] such as a cement or mortar paste, to inhibit rapid moisture loss from the cavity. At the end of a brief high current treatment when the formation of voluminous products slows down, it is preferable to seal the opening to the external environment and to use other space within the cavity to accommodate the voluminous products.

A space may be provided by including voids within the backfill [6] or voids within the cavity [7]. The void space may be created using a filler material that traps a compressible fluid like air within the putty or within the cavity. An example of a filler material is a weak foamed polymer such as polystyrene foam.

Figure 2:
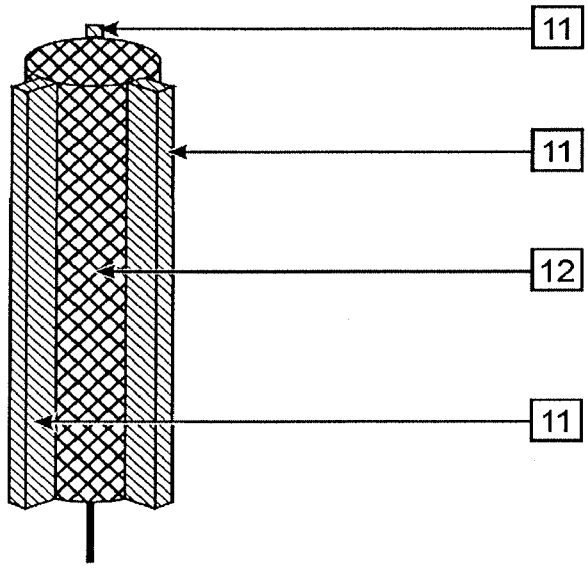
FIG. 2 shows an anode with strips of compressible foamed polymer attached to the sacrificial metal element.

FIG. 2 shows an example of another anode arrangement where a compressible material such as polystyrene or polyurethane foam [11] is attached to the sacrificial metal element [12] of the anode to form a compressible space. This arrangement has the advantage that the compressible material is located where it is most needed. The use of strips of compressible material can be used to guide the anode into the centre of the cavity formed in the concrete.

The anode and backfill may be assembled as a separate unit prior to installation in a concrete structure. This may be achieved by forming a porous container or mould with an opening to facilitate placing the backfill and anode in the container. The porous mould or container may be made using a layer of hydraulic cement or mortar formed into an appropriate shape. Excess water in the cement results in the formation of capillary porosity as the cement hydrates. The mould or container may also be formed from a material like cardboard or a porous cloth or even one or more layers of thin absorbent paper impregnated with a hydraulic cement with a high water to cement ratio. The use of a cement that sets to form a porous material such as hydraulic cement results in a rigid container or mould.

The pliable viscous backfill is installed within the container and the anode is inserted into the backfill. The container then forms an outer porous layer of the anode assembly. A conductor connected to the anode protrudes from the container to facilitate making a connection to the anode. The opening to the container may be sealed after the backfill and anode are installed in the container. If an opening venting the backfill to the external environment is left, it is preferable that the container is a rigid container. If no opening is left, it is preferable that one or more features is present from the list comprising, a portion of the container or seal is easily broken to create an opening when the anode is used, a portion of the container or seal is elastomeric, a compressible void space is present in the container. These features are needed to accommodate expansion within the anode assembly.

EXAMPLE

An anode 15 mm in diameter and 100 mm long comprising a bar of the aluminium alloy known as US Navy specification MIL-A-24779(SH) that was cast around a titanium wire to facilitate the electrical connection to the aluminium was embedded in a lime putty in a 25 mm diameter by 130 mm deep hole in a concrete block. The basic arrangement is shown in FIG. 1. The concrete block measuring 380 by 270 by 220 mm was made using graded all-in-one 20 mm aggregate and ordinary Portland cement in the ratio 8:1. The water to cement ratio was 0.6 and 4% chloride ion by weight of cement was added to the mix by dissolving sodium chloride in the mix water. A sheet of steel with a surface area of 0.125 $m^2$ was included in the concrete block. The lime putty was produced by slaking and maturing quicklime and was sourced from a manufacturer of lime putty and lime mortars. The hole in the concrete block containing the lime putty and the anode was left open to the air. The concrete block was stored in a dry indoor environment and the temperature varied between 10 and 20 C.

The anode and the steel were connected to a 12 Volt DC power supply for a period of 13 days during which a charge of 65 kC was delivered from the anode to the steel. The current density delivered off the anode for the first 11 days is given in FIG. 2. For most of this time, the current delivered off the anode was greater than 5000 $mA/m^2$. During this period water and corrosion products accumulated at the location of the anode and moved out of the hole containing the anode and the putty onto the surface of the concrete.

Figure 3:
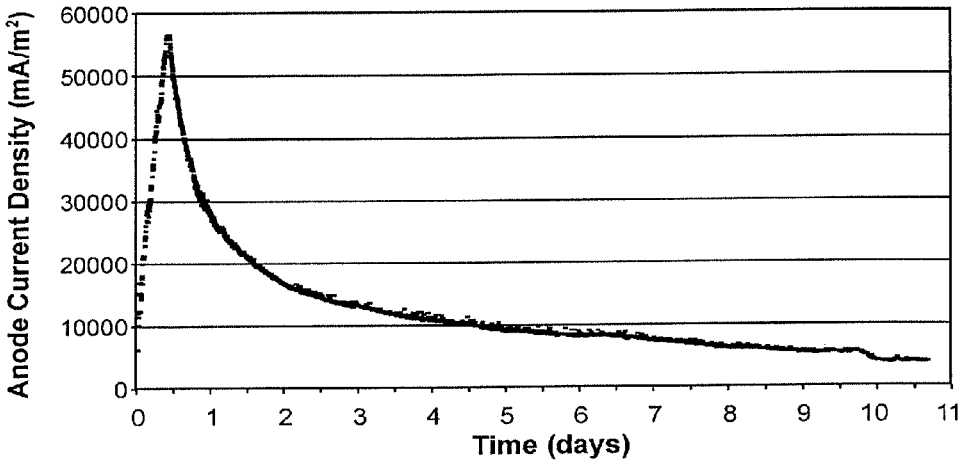
FIG. 3 shows the current density driven off an aluminium anode embedded in a lime putty in concrete using a 12V DC power supply connected between the anode and the steel in the concrete.
Figure 4:
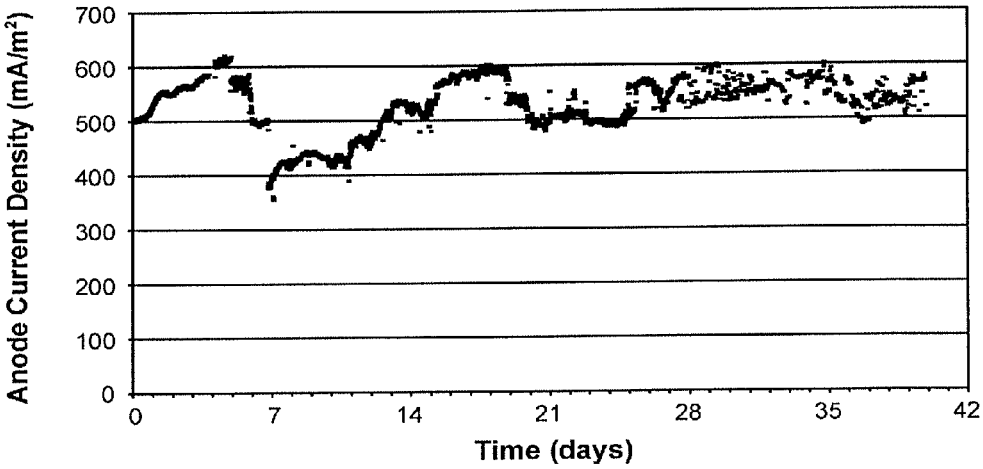
FIG. 4 shows the galvanic current density off an aluminium anode connected to the steel after completing the impressed current treatment described in FIG. 3.

At the end of the period of impressed current treatment, the DC supply was removed and the anode was connected to the steel. The galvanic current out of the anode was measured using a 1 ohm resistor as a current sensor in the connection between the anode and the steel. The current density delivered off the anode acting purely in a galvanic mode for the next 40 days is given in FIG. 3. For most of this period, the current density delivered off the anode was between 500 and 600 $mA/m^2$. This indicates that a high degree of anode activation was achieved by drawing chloride from the concrete into the backfill around the sacrificial metal element during the impressed current treatment.

The invention claimed is:

1. An anode and backfill steel reinforced concrete protection combination for use in cavities in concrete comprising:

a compact discrete sacrificial anode less noble than steel, and a pliable and viscous and ionically conductive backfill, wherein the conductivity of the backfill primarily arises from one or more dissociated salts in an electrolyte contained within the backfill, the backfill retains its pliable viscous properties for at least 48 hours, and the backfill hardens to form a porous material and a compressive strength of the backfill does not exceed 2 N/mm2 within 7 days of exposure to air.

2. An anode and backfill steel reinforced concrete protection combination for use in cavities in concrete comprising:

a compact discrete sacrificial anode less noble than steel, and a pliable and viscous and ionically conductive backfill, wherein the conductivity of the backfill primarily arises from one or more dissociated salts in an electrolyte contained within the backfill, the backfill retains its pliable viscous properties for at least 48 hours and the backfill includes a means to improve dimensional stability of the backfill.

3. The anode and backfill steel reinforced concrete protection combination according to claim 2, wherein the backfill comprises solid particles for improving the dimensional stability of the backfill.

4. The anode and backfill steel reinforced concrete protection combination according claim 2, wherein the backfill comprises solid particles larger than clay particles.

5. The anode and backfill steel reinforced concrete protection combination according to claim 2, wherein the backfill includes a water content that is less than 60% of the weight of the backfill.

6. The anode and backfill steel reinforced concrete protection combination according to claim 2, wherein the backfill hardens to form a porous material and a compressive strength of the backfill does not exceed 2 N/mm2 within 7 days of exposure to air.

7. An anode and backfill steel reinforced concrete protection combination comprising:

a compact, discrete, sacrificial anode less noble than steel;

a pliable, viscous, ionically conductive backfill;

a conductivity of the backfill arises primarily from one or more dissociated salts in an electrolyte contained within the backfill;

the backfill retains its pliable and viscous properties for at least 48 hours; and the backfill includes at least one of:

a putty of sufficient viscosity to hold the anode in position in the cavity, a lime putty, a clay, and a retarded cement and solid particles larger than clay particles.

8. The anode and backfill steel reinforced concrete protection combination according to claim 7, wherein the backfill includes putty for holding the anode in position within the cavity.

9. The anode and backfill steel reinforced concrete protection combination according to claim 7, wherein the backfill includes lime putty.

10. The anode and backfill steel reinforced concrete protection combination according to claim 7, wherein the backfill includes clay.

11. The anode and backfill steel reinforced concrete protection combination according to claim 7, wherein the backfill includes retarded cement.

12. The anode and backfill steel reinforced concrete protection combination according to claim 7, wherein the backfill includes solid particles larger than clay particles.

13. The anode and backfill steel reinforced concrete protection combination according to claim 7, wherein the water content of the backfill is less than 60% of a weight of the backfill.

14. The anode and backfill steel reinforced concrete protection combination according to claim 7, wherein the backfill hardens upon exposure to air to form a porous material; and a compressive strength of the backfill does not exceed 2 $N/mm^2$ for at least 7 days of exposure to air.

* * * * *